US005685204A

United States Patent [19]

Braun

[11] Patent Number: 5,685,204

[45] Date of Patent: Nov. 11, 1997

[54] MINIATURE REVERSIBLE RATCHETING SCREWDRIVER

[75] Inventor: John A. Braun, Kenilworth, N.J.

[73] Assignee: Snap-on Technologies, Inc., Lincolnshire, Ill.

[21] Appl. No.: 586,253

[22] Filed: Jan. 16, 1996

[51] Int. Cl.[6] ..... B25B 15/04

[52] U.S. Cl. ..... 81/63.1; 81/60

[58] Field of Search ..... 81/60–63.2

[56] References Cited

U.S. PATENT DOCUMENTS

| | | | |
|---|---|---|---|
| 731,886 | 6/1903 | George . | |
| 855,292 | 11/1907 | Ellrich . | |
| 1,493,353 | 5/1924 | Leopold . | |
| 2,143,121 | 1/1939 | Cox . | |
| 2,296,320 | 9/1942 | Waldo . | |
| 2,348,611 | 5/1944 | Davidson . | |
| 2,720,296 | 10/1955 | Briglia . | |
| 2,773,574 | 12/1956 | Able . | |
| 3,149,707 | 9/1964 | McInnis . | |
| 3,290,969 | 12/1966 | Bergquist et al. | 81/63.1 |
| 3,330,316 | 7/1967 | MacNeill . | |
| 4,063,626 | 12/1977 | Solomon . | |
| 4,257,507 | 3/1981 | Solomon . | |
| 4,419,911 | 12/1983 | Claudy . | |
| 4,777,852 | 10/1988 | Herman et al. | 81/63.1 |
| 5,520,073 | 5/1996 | Bakula et al. | 81/63.2 X |
| 5,535,648 | 7/1996 | Braun et al. | 81/63.1 |

*Primary Examiner*—D. S. Meislin
*Attorney, Agent, or Firm*—Emrich & Dithmar

[57] ABSTRACT

A reversible ratcheting driver handle has an axial cavity in one end receiving an insert which defines an axial compartment for receiving a ratchet mechanism including a rotatable gear and two pawls seated in recesses in the insert and for reciprocating movement along parallel paths between engaged and disengaged conditions relative to the gear, being spring-biased to the engaged conditions. A selector cap telescopes with the one end of the handle and has a recess non-rotatably receiving a control member which has a part-cylindrical actuator wall which fits part way around the gear and has opposite end engageable with the pawls for shifting them to their disengaged conditions in response to rotation of the cap. Roll pins secure the cap, the insert and the handle together while limiting rotational movement to the cap.

17 Claims, 3 Drawing Sheets

MINIATURE REVERSIBLE RATCHETING SCREWDRIVER

BACKGROUND OF THE INVENTION

1. Field of the Invention

The present invention relates to reversible ratcheting driver mechanisms and, in particular, to the structure for controlling shifting of the mechanism among forward and reverse ratcheting modes and a non-ratcheting mode. The invention has particular application to driver tools which are of very small or miniature size.

2. Description of the Prior Art

The present invention is an improvement of the reversible ratcheting screwdriver disclosed in the copending U.S. application Ser. No. 394,490, filed Feb. 27, 1995, now U.S. Pat. No. 5,535,648. That application discloses two embodiments of miniature ratcheting screwdriver, one of which utilizes pivoting pawls, and the other of which utilizes balls which are translationally movable into and out of engagement with ratchet gear teeth along intersecting paths. While both of these techniques have been found to function in a miniature size environment, the pivoting pawl arrangement is of relatively complex construction and the ball-type arrangement does not afford consistent positive engagement of the balls with the gear teeth.

Another pivoting pawl arrangement is disclosed in U.S. Pat. No. 4,466,523, but that ratchet mechanism is also of complicated construction and utilizes a plurality of pairs of pawls.

U.S. Pat. No. 4,777,952 discloses a reversible ratcheting screwdriver utilizing reciprocating pawls. While this construction provides a good positive engagement of the pawls with the ratchet gear, it requires an actuating lever interposed between a selector cap and the pawls for effecting movement of the pawls among their different modes of operation.

SUMMARY OF THE INVENTION

It is a general object of the present invention to provide an improved reversible ratcheting driver handle which avoids the disadvantages of prior constructions while affording additional structural and operating advantages.

An important feature of the invention is the provision of a ratcheting driver handle of the type set forth which is of relatively simple and economical construction.

A further feature of the invention is the provision of a ratcheting driver handle of the type set forth, which affords good positive engagement of pawls with a ratchet gear, while at the same time being conducive to construction in a very small or miniaturized size.

A still further feature of the invention is the provision of a ratcheting driver handle of the type set forth, which provides for direct engagement between a rotating control member and the ratchet pawls.

Certain ones of these and other features of the invention are attained by providing a ratcheting driver handle for a driver having a shank, the handle comprising: an elongated body having an axis and an axial cavity in one end thereof, a ratchet mechanism disposed in the cavity and including a gear and first and second pawls engageable with the gear, two recesses formed in the handle and communicating with the cavity and respectively receiving the pawls and arranged for respectively guiding reciprocating movement of the pawls along substantially parallel paths between engaged and disengaged conditions relative to the gear, resilient elements biasing the pawls to their engaged conditions, the ratchet mechanism having a first condition wherein only the first pawl is in its engaged condition so that the body rotates the gear with the body when the body is rotated in one direction and the body ratchets with respect to the gear when the body is rotated in the opposite direction, the ratchet mechanism having a second condition wherein only the second pawl is in its engaged condition so that the body rotates the gear with the body when the body is rotated in the opposite direction and the body ratchets with respect to the gear when the body is rotated in the one direction, a selector member coupled to the one end of the body and accessible by a user for manual movement with respect to the one end between first and second positions respectively corresponding to the first and second conditions of the ratchet mechanism, and an actuator member carried by the selector member and extending parallel to the axis and positioned and dimensioned for direct engagement with the pawls for movement of the second pawl to its disengaged condition in response to movement of the selector member to its first position and for movement of the first pawl to its disengaged condition in response to movement of the selector member to its second position.

Further features of the invention are attained by providing a ratcheting driver handle for a driver having a shank, the handle comprising: an elongated body having an axis and an axial cavity in one end thereof, a ratchet mechanism disposed in the cavity and including a gear and a pawl assembly including at least one pawl engageable with the gear, the ratchet mechanism having a bore for receiving therein the shank of the associated driver, mounting means for the pawl assembly accommodating movement of the at least one pawl between first and second conditions, the at least one pawl including a first tooth portion engaging the gear in the first condition of the pawl assembly so that the body rotates the gear with the body when the body is rotated in one direction and the body ratchets with respect to the gear when the body is rotated in an opposite direction, the pawl assembly including a second tooth portion engaging the gear in the second condition of the pawl assembly so that the body rotates the gear with the body when the body is rotated in the opposite direction and the body ratchets with respect to the gear when the body is rotated in the one direction, a selector member coupled to the one end of the body and accessible by a user for manual movement with respect to the one end between first and second positions corresponding respectively to the first and second conditions of the pawl assembly, and a control member coupled to the selector member for movement therewith, the control member including an actuator extending parallel to the axis and positioned and dimensioned for direct engagement with the at least one pawl for movement of the at least one pawl between its first and second conditions in response to movement of the selector member between its first and second positions.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DESCRIPTION OF THE PREFERRED EMBODIMENT

Figures 1, 2, 18, 19:
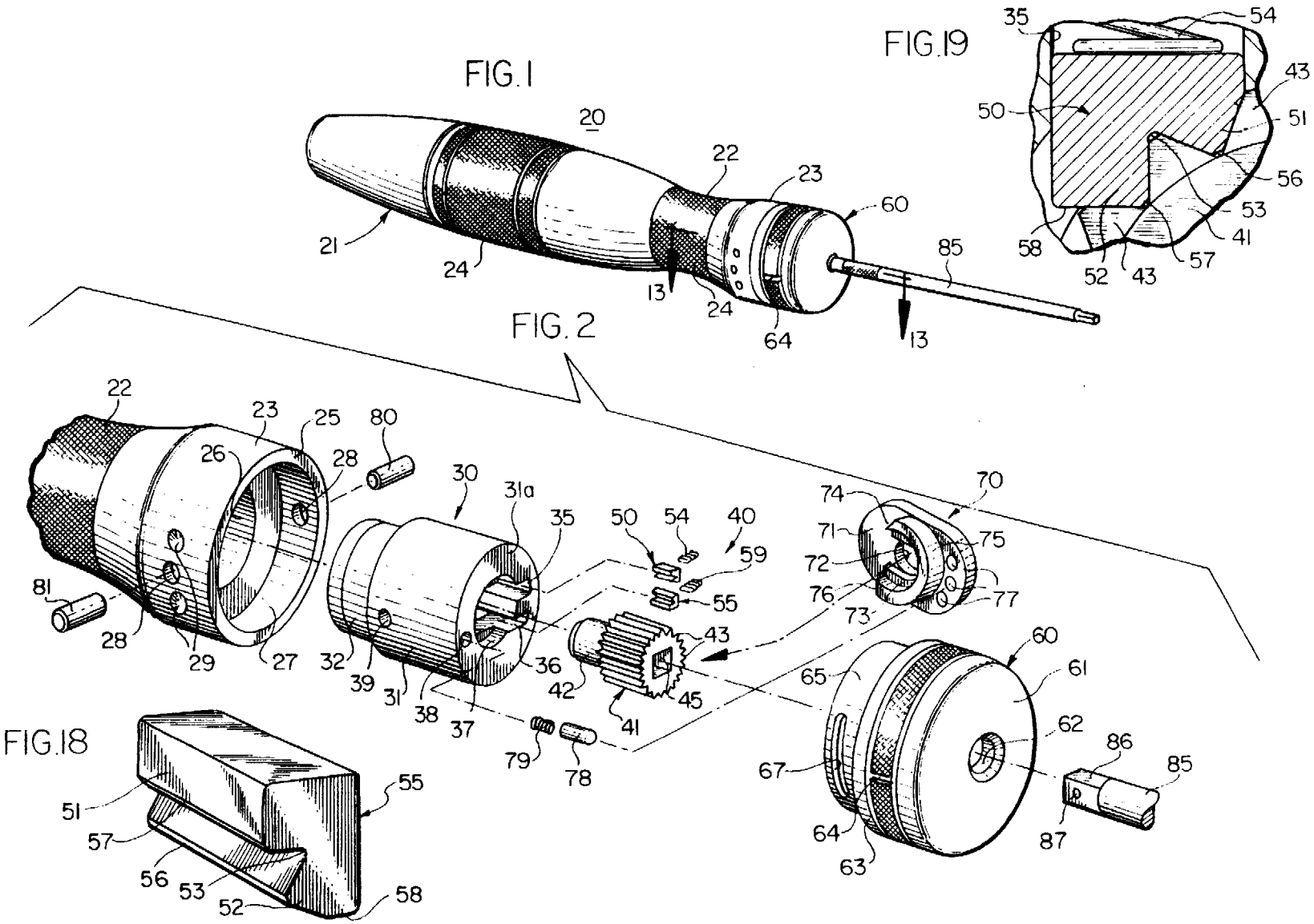
FIG. 1 is a perspective view of a ratcheting screwdriver constructed in accordance with and embodying the features of the present invention.
FIG. 2 is an enlarged, fragmentary, exploded, perspective view of the ratchet mechanism of the screwdriver of FIG. 1.
FIG. 18 is an enlarged perspective view of one of the pawls of the ratchet mechanism of FIG. 2.
FIG. 19 is an enlarged, fragmentary, sectional view of a portion of FIG. 16, illustrating the engagement between the gear and one of the pawls.
Figure 8:
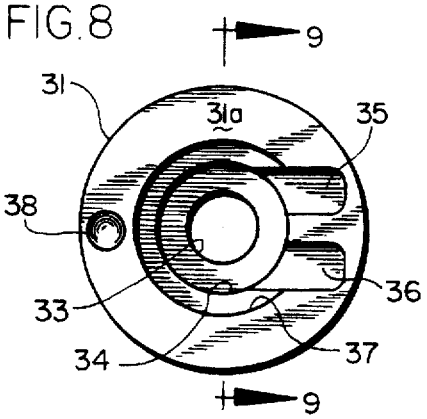
FIG. 8 is further enlarged end elevational view of the insert of the handle of FIG. 2.
Figure 9:
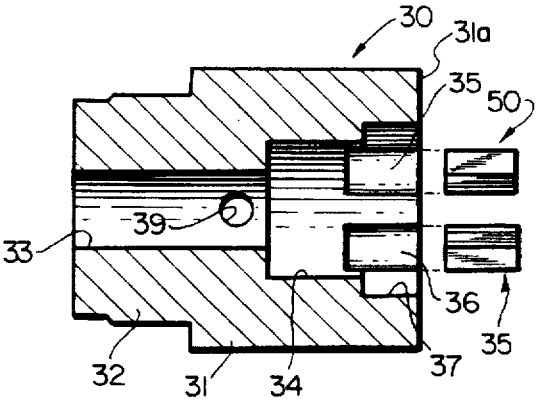
FIG. 9 is a view in vertical section taken along the line 9—9 in FIG. 8, and illustrating the pawls in exploded relationship.
Figure 10:
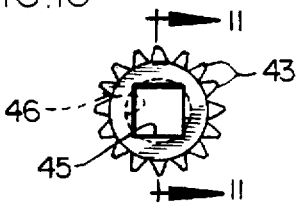
FIG. 10 is a front end elevational view of the ratchet gear of the ratchet mechanism of FIG. 2.
Figure 11:
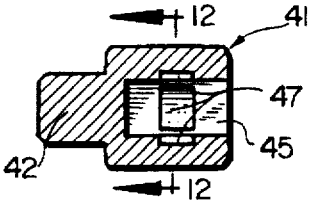
FIG. 11 is a view in vertical section taken along the line 11—11 in FIG. 10.
Figure 12:
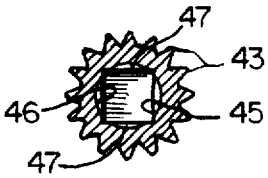
FIG. 12 is a view in vertical section taken along the line 12—12 in FIG. 11.
Figure 13:
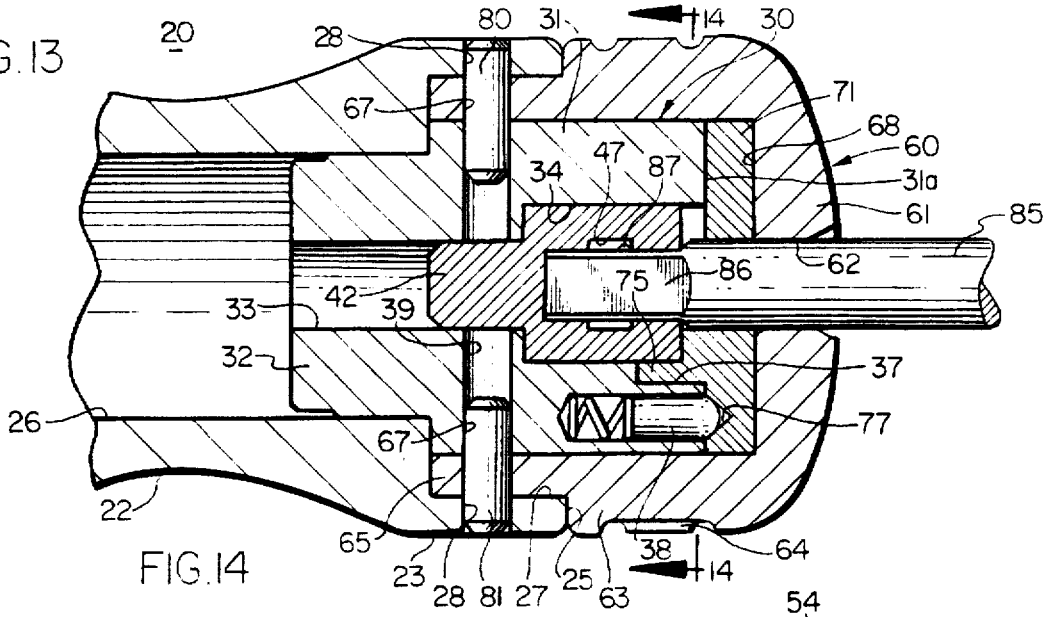
FIG. 13 is an enlarged, fragmentary view in vertical section taken generally the line 13—13 in FIG. 1, with the ratchet mechanism shown in its non-ratcheting mode.

Referring to FIGS. 1 and 2, there is illustrated a reversible ratcheting driver 20, constructed in accordance with and embodying the features of the present invention. While the driver 20 is illustrated as a screwdriver, it will be appreciated that the principles of the present invention would apply equally well to other drivers, such as nut drivers and the like. The driver 20 has an elongated handle 21 provided with a necked-down portion 22 and a working end 23, the outer surface of the handle 21 preferably being provided with knurling 24 in appropriate locations. Referring also to FIG. 13, the working end 23 has a planar end wall 25 in which is formed an axial bore 26 and a counterbore 27. Extending diametrically through the wall of the working end 23 axially intermediate of ends of the counterbore 27 is a bore 28. Circumferentially aligned with one end of the bore 28 and respectively disposed on opposite sides thereof are two indicia indents 29. Referring also to FIGS. 8 and 9, the driver 20 includes an insert 30 having a cylindrical main body 31 having a planar end surface 31*a* at one end thereof and a reduced-diameter portion 32 at the other end thereof. An axial bore 33 is formed through the insert 30, being provided at one end with a counterbore 34 defining a cavity for receiving a portion of a ratchet mechanism to be described more fully below. Communicating with the counterbore 34 and extending laterally therefrom parallel to and on opposite sides of a radius thereof, are two elongated, generally rectangular pawl recesses 35 and 36. Each of the recesses 35 and 36 extends from the end face of the insert 30 in which the counterbore 34 is formed to a depth approximately half the depth of the counterbore 34. Also formed in that same end of the insert 30, coaxially with the counterbore 34, is a part-cylindrical recess 37 having a diameter greater than that of the counterbore 34 and extending circumferentially from the outer side wall of the pawl recess 45 to the outer side wall of the pawl recess 36. Also formed in the end surface 31*a* parallel to the axis of the insert 30 is a cylindrical pin socket 38. Formed diametrically through the main body 31 adjacent to the reduced-diameter portion 32 is a bore 39, the axis of which lies in the radial plane between the pawl recesses 35 and 36.

A ratchet mechanism 40 is carried by the insert 30. More particularly, referring also to FIGS. 10–12 and 18, the ratchet mechanism 40 includes a cylindrical gear 41 having a reduced-diameter end portion 42 and being provided with a plurality of circumferentially arranged teeth 43. Referring in particular to FIG. 18, the gear preferably is formed with flats 44 at the crest of each of the teeth 43 and at the valleys therebetween. Formed axially in the large-diameter end of the gear 41 is a socket 45 substantially square in transverse cross section. Formed coaxially with the socket 45 approximately axially midway along its depth is a cylindrical recess 46 which has a diameter greater than the width of the socket 45 but slightly less than the across-corner dimension thereof, thereby to from four shallow part-cylindrical detent recesses 47.

Figure 14:
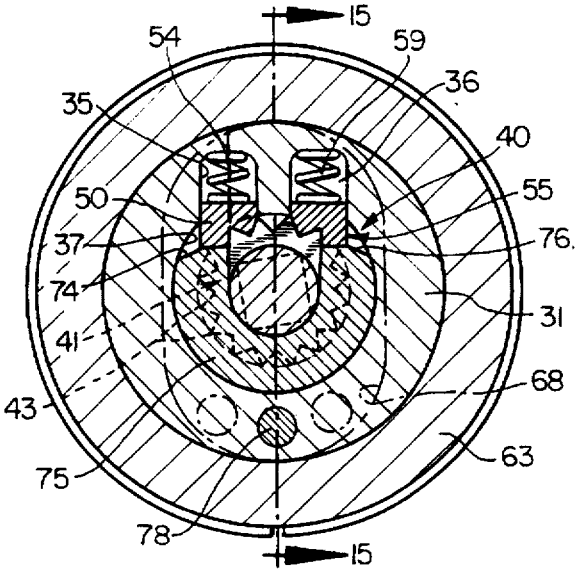
FIG. 14 is a view in vertical section taken along the line 14—14 in FIG. 13.

Referring in particular to FIGS. 2, 9, 18 and 19, the ratchet mechanism 40 includes two pawls 50 and 55 which are of substantially identical construction, wherefore only the pawl 50 will be described in detail. The pawl 50 is substantially in the shape of an elongated, generally rectangular block being cut away along two adjacent perpendicular surfaces thereof to define generally triangular teeth 51 and 52 and a generally V-shaped valley 53 therebetween. The teeth 51 and 52, respectively, have truncated crests defining flats 56 and 57, whereas the valley 53 is preferably radiused, whereby the pawl teeth are shaped and dimensioned for mating engagement with the teeth 43 of the ratchet gear 41, as is best illustrated in FIG. 19. One of the cut away sides of the pawl block defines a bearing surface 58, for a purpose to be described more fully below. Referring further to FIG. 14, the pawls 50 and 55 are dimensioned to be fitted, respectively, in the pawl recesses 35 and 36 of the insert 30 for reciprocating sliding movement therein toward and away from the gear 41. Oval-shaped coil compression springs 54 and 59 are, respectively, seated in the pawl recesses 35 and 36 for respectively resiliently urging the pawls 50 and 55 into engagement with the gear 41.

Figure 3:
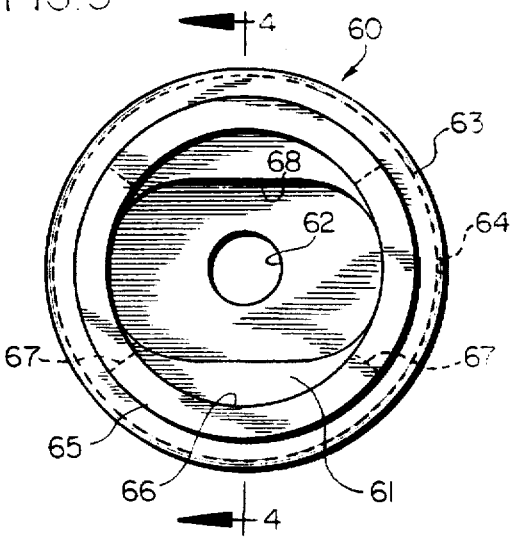
FIG. 3 is a further enlarged rear end elevational view of the selector cap of the screwdriver of FIG. 1.
Figure 4:
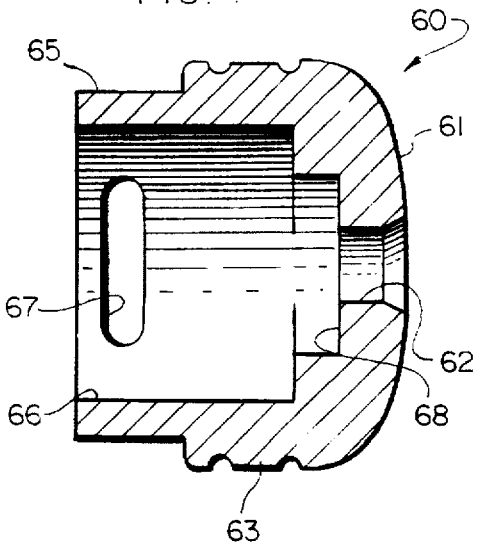
FIG. 4 is a view in vertical section taken along the line 4—4 in FIG. 3.

Referring now also to FIGS. 3 and 4, the driver 20 also includes a control cap 60 which is generally cup-shaped, having a circular end wall 61 with an axial bore 62 formed therethrough and a cylindrical side wall 63. The side wall 63 may be provided with suitable knurling on its outer surface and is also provided with an axially extending indicium groove 64 in the outer surface thereof. The cylindrical side wall 63 has a end portion 65 with a reduced-diameter outer surface. The cap 60 has a circularly cylindrical inner surface 66. Two elongated, circumferentially extending slots 67 are formed through the reduced end 65 of the cylindrical side wall 63 at diametrically opposed locations thereon. Formed in the inner surface of the end wall 61 is an elongated oval recess 68 which, at its opposite ends, is tangent to the cylindrical inner surface 66. The recess 68 is oriented so that its longitudinal axis lies in the diametral plane which bisects the slots 67, as can best be seen in FIG. 3.

Figure 5:
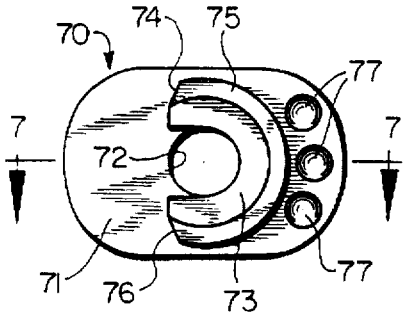
FIG. 5 is a further enlarged rear elevational view of the control member of the ratchet mechanism of FIG. 2.
Figure 6:
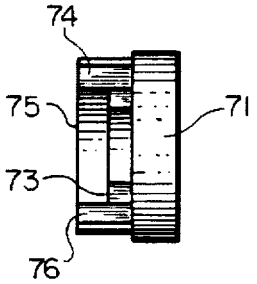
FIG. 6 is a end elevational view of the control member of FIG. 5, as viewed from the left-hand thereof.
Figure 7:
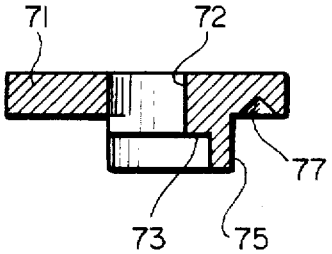
FIG. 7 is a view in horizontal section taken along the line 7—7 in FIG. 5.
Figure 15:
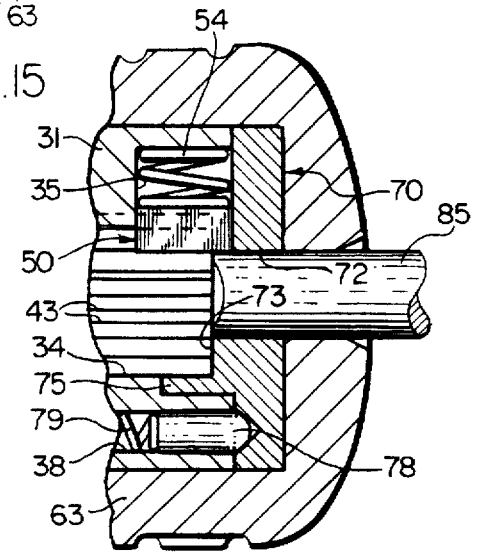
FIG. 15 is a fragmentary view in vertical section taken along the line 15—15 in FIG. 14.

Referring also to FIGS. 5–7, the driver 20 includes a control member 70 which has an elongated, generally oval baseplate 71 dimensioned to be mateably received in the recess 68 of the control cap 60 (see FIGS. 13–15). A circular hole 72 is formed through the plate 71 centrally thereof. Unitary with the plate 71 and projecting from one side thereof is a generally horseshoe-shaped stop shoulder 73, the closed end of which is congruent with one half of the hole 72, and the open end of which faces one of the ends of the plate 71. Projecting from the shoulder 73 along the outer periphery thereof coaxially therewith is a part-cylindrical actuator wall 75 having ends which are substantially coterminous with those of the stop shoulder 73. The ends of the actuator wall 75 and the adjacent portions of the stop shoulder ends are beveled or truncated, as at 74 and 76. Formed in the surface of the plate 71 from which the stop shoulder 73 projects, adjacent to the closed end of the stop shoulder 73, are three equidistantly spaced apart generally conical detent recesses 77.

In assembly, the insert 30 is first seated in the counterbore 27 of the handle 21, with the reduced portion 32 thereof seated in the handle axial bore 26, as can best been seen in FIG. 13, with the diametral bore 39 aligned with the bores 28 of the handle 21, thereby to form a handle assembly. Next the gear 41 is seated in the insert counterbore 34 with its reduced end portion 42 fitted in the axial bore 33 of the insert 30. The pawls 50 and 55 are then fitted in the pawl recesses 35 and 36 for engagement with the gear teeth 43, and the springs 54 and 59 are then inserted behind the pawls. The handle 21 is also provided with a detent pin 78 and a helical compression spring 79 (FIGS. 2, 13 and 15) which are seated in the pin socket 38 so that the pin 78 is biased outwardly. Next, the control member 70 is placed on top of the ratchet mechanism 40, oriented so that the center one of the detent recesses 77 engages over the detent pin 78. In this orientation, the part-cylindrical actuator wall 75 will fit into the part-cylindrical recess 37 of the insert 30 around the gear 41, so that the ends of the stop shoulder 73 respectively engage the bearing surfaces 58 of the pawls 50 and 55. The cap 60 is then placed over the entire assembly, with the baseplate 71 of the control member 70 seating in the cap recess 68, and with the reduced end 65 of the cylindrical side wall 63 fitted into the handle counterbore 27 between the handle wall and the insert 30. The control cap 60 is oriented so that the slots 67 respectively align with the handle bore 28 and the insert bore 39, and with the indicium groove 64 axially aligned with the end of the handle bore 28 which opens between the indicia detents 29. Roll pins 80 and 81 are then fitted through the opposite ends of the aligned handle and insert bores 28 and 39 and the cap slots 67 for holding the assembly together (FIGS. 2 and 13).

It will be appreciated that the driver 20 is adapted for use with an associated shank 85 (FIGS. 1, 2, 13 and 15) dimensioned to be received through the cap bore 62 and the control member hole 72. The shank 85 is provided with a square coupling end 86 dimensioned to be mateably received in the square socket 45 of the gear 41, and with a detent ball 87 to be received in one of the detent recesses 47 of the gear 41 (FIG. 13) for releasably retaining the shank 85 in place in a known manner.

Figure 16:
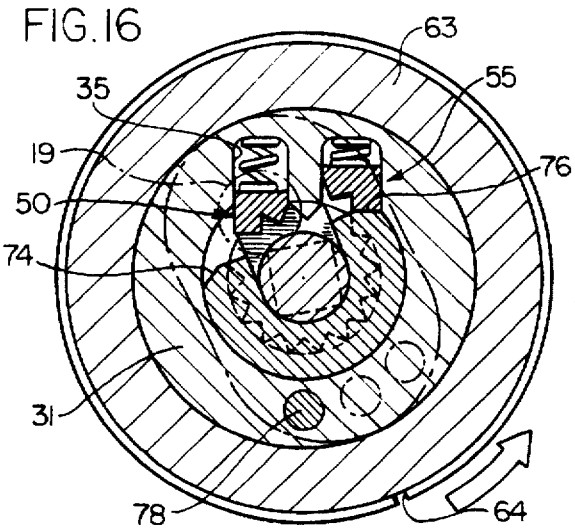
FIG. 16 is a view similar to FIG. 14, with the ratcheting mechanism shown in a forward ratcheting mode.
Figure 17:
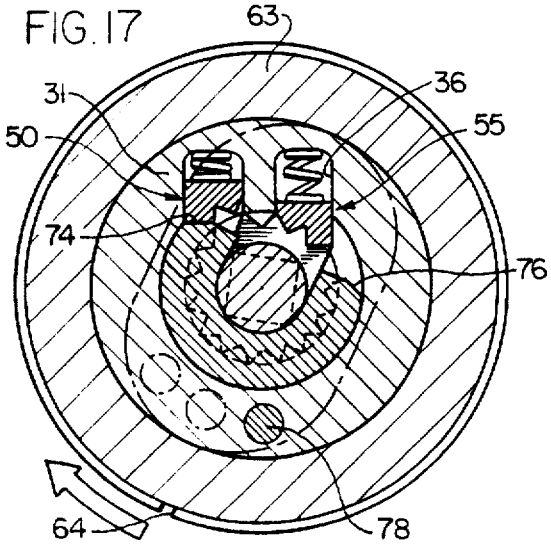
FIG. 17 is a view similar to FIG. 16, but with the ratchet mechanism illustrated in a reverse ratcheting mode.

In operation, the ratchet mechanism 40 is operable in non-ratcheting, forward-ratcheting and reverse-ratcheting modes, respectively illustrated in FIGS. 14, 16 and 17. As was explained above, when the driver 20 is initially assembled it will be in the non-ratcheting configuration of FIGS. 13–15. In this configuration, both of the pawls 50 and 55 are resiliently urged into engagement with the gear 51, effectively preventing ratcheting of the mechanism in either direction and locking the gear 41 (and its associated shank 85) to the handle 21, so that the shank 85 rotates with the handle 21 as a standard screwdriver. When it is desired to operate the driver 20 in a forward ratcheting mode, the cap 60 is rotated to the position illustrated in FIG. 16, thereby rotating the control member 70, so that the beveled end 76 of the part-cylindrical actuator wall 75 is brought into engagement with the pawl 55, moving it out of engagement with the gear 41 against the urging of the spring 59. Thus, the operation of the driver 20 will be controlled solely by the pawl 50 so that, when the handle 21 is rotated in the direction of the arrow in FIG. 16, the pawl 50 is locked in engagement with the gear 41 so that the shank 85 rotates with the handle 21, and when the handle 21 is rotated in the opposite direction, the pawl 50 ratchets past the gear 41 in a known manner.

Similarly, when it is desired to operate the driver 20 in a reverse ratcheting mode, the cap 60 is manually rotated to the position illustrated in FIG. 17. In this configuration, the beveled end 74 of the cylindrical actuator wall 75 engages the bearing surface 58 of the pawl 50 for moving the pawl 50 out of engagement with the gear 41 against the urging of the compression spring 54. In this configuration, operation of the driver 20 is controlled solely by the pawl 55 so that, when the handle 21 is rotated in the direction of the arrow in FIG. 17, the pawl 55 is locked in engagement with the gear 41 so that the shank 85 rotates with the handle 21 while, when the handle 21 is rotated in the opposite direction, the pawl 55 ratchets past the gear 41 in a known manner.

It will be appreciated, that the engagement of the detent pin 78 in the detent recesses 77 will serve to resiliently retain the cap 60 and the ratchet mechanism 40 in the selected one of the three operating modes. Further, it can be seen that the engagement of the roll pins 80 and 81 with the ends of the cap slots 67 serves to limit rotational movement of the cap 60.

From the foregoing, it can be seen that there has been provided an improved reversible ratcheting driver which is of a construction which is conducive to miniaturization while, at the same time affording a firm engagement of the pawls with the ratchet gear.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

I claim:

1. A ratcheting driver handle for a driver having a shank, said handle comprising: an elongated body having an axis and an axial cavity in one end thereof, a ratchet mechanism disposed in said cavity and including a gear and first and second pawls engageable with said gear, two recesses formed in said handle and communicating with said cavity and respectively receiving said pawls and arranged for respectively guiding reciprocating movement of said pawls along substantially parallel paths between engaged and disengaged conditions relative to said gear, resilient elements biasing said pawls to their engaged conditions, said ratchet mechanism having a first condition wherein only said first pawl is in its engaged condition so that said body rotates said gear with said body when the body is rotated in one direction and said body ratchets with respect to said gear when said body is rotated in the opposite direction, said ratchet mechanism having a second condition wherein only said second pawl is in its engaged condition so that said body rotates said gear with said body when said body is rotated in said opposite direction and said body ratchets with respect to said gear when said body is rotated in said one direction, a selector member coupled to said one end of said body and accessible by a user for manual movement with respect to said one end between first and second positions respectively corresponding to said first and second conditions of said ratchet mechanism, and an actuator member carried by said selector member and extending parallel to said axis and positioned and dimensioned for direct engagement with said pawls for movement of said second pawl to its disengaged condition in response to movement of said selector member to its first position and for movement of said first pawl to its disengaged condition in response to movement of said selector member to its second position, said selector member including a substantially cylindrical portion in overlapping telescoping relationship with said one end of said body and having an elongated circumferentially extending slot therethrough, and further comprising a pin extending through said slot and said one end of said handle body for mounting said selector member on said handle body and accommodating limited rotational movement of said selector member relative to said body between the first and second positions, and an insert seated in said axial cavity, said insert having a compartment therein receiving said ratchet mechanism, said pin extending into said insert for securing said insert to said handle body.

2. The driver handle of claim 1, wherein each of said pawls includes at least one tooth engageable with said gear.

3. The driver handle of claim 2, wherein each of said pawls includes two teeth disposed for engagement with said gear.

4. The driver handle of claim 1, said pawls are of substantially identical construction.

5. The driver handle of claim 1, and further comprising bias springs respectively resiliently urging said pawls to their engaged conditions.

6. The driver handle of claim 5, wherein each of said pawls is elongated axially of said gear, each of said springs being an elongated, oval-shaped coil compression spring.

7. The driver handle of claim 1, wherein said selector member includes a non-circular recess for mateably receiving said actuator member therein so that said actuator member rotates with said selector member.

8. The driver handle of claim 7, wherein said actuator member including a part-cylindrical portion having opposite ends respectively engageable with said pawls for moving said pawls to their disengaged condition in response to movement of said selector member.

9. The driver handle of claim 8, wherein each of said ends of said part-cylindrical portion has a tapered non-radial surface for controlled engagement with the associated one of said pawls.

10. The driver handle of claim 1, wherein said pawl assembly has a third condition wherein each of said pawls is disposed in its engaged condition, said selector member being movable to a third position corresponding to said third condition wherein said actuator member does not displace either of said pawls from its engaged condition.

11. A ratcheting driver handle for a driver having a shank, said handle comprising: an elongated body having an axis and an axial cavity in one end thereof, a ratchet mechanism disposed in said cavity and including a gear and a pawl assembly including at least one pawl engageable with said gear, said ratchet mechanism having a bore for receiving therein the shank of the associated driver, mounting means for said pawl assembly accommodating movement of said at least one pawl between first and second conditions, said at least one pawl including a first tooth portion engaging said gear in the first condition of said pawl assembly so that said body rotates said gear with said body when the body is rotated in one direction and said body ratchets with respect to said gear when said body is rotated in an opposite direction, said pawl assembly including a second tooth portion engaging said gear in the second condition of said pawl assembly so that said body rotates said gear with said body when said body is rotated in said opposite direction and said body ratchets with respect to said gear when said body is rotated in said one direction, a selector member coupled to said one end of said body and accessible by a user for manual movement with respect to said one end between first and second positions corresponding respectively to said first and second conditions of said pawl assembly, and a control member coupled to said selector member for movement therewith, said control member including an actuator extending parallel to said axis and positioned and dimensioned for direct engagement with said at least one pawl for movement of said at least one pawl between its first and second conditions in response to movement of said selector member between its first and second positions, said selector member including a substantially cylindrical portion in overlapping telescoping relationship with said one end of said body and having an elongated circumferentially extending slot therethrough, and further comprising a pin extending through said slot and said one end of said handle body for mounting said selector member on said handle body and accommodating limited rotational movement of said selector member relative to said body between the first and second positions, and an insert seated in said axial cavity, said insert having a compartment therein receiving said ratchet mechanism, said pin extending into said insert for securing said insert to said handle body.

12. The drivers handle of claim 11, wherein said selector member is rotatably movable about said axis between the first and second conditions, said selector member including a non-circular recess for mateably receiving said control member therein so that said control member rotates with said selector member.

13. The driver handle of claim 11, wherein said control member is a part-cylindrical member having ends respectively engageable with spaced-apart portions of said pawl assembly.

14. The driver handle of claim 13, wherein each of said ends of said control member has a tapered non-radial surface disposed for controlled engagement with the associated portion of said pawl assembly.

15. The driver handle of claim 11, wherein said pawl assembly includes two pawls, said ratchet mechanism including structure guiding said pawls for reciprocating movement along substantially parallel paths between engaged and disengaged conditions relative to said gear.

16. The driver handle of claim 11, wherein said selector member and said control member have aligned openings therethrough receiving the associated shank of the driver.

17. The driver handle of claim 11, wherein said selector member is movable to a third position corresponding to a third condition of said pawl assembly wherein said actuator member does not displace either of said first and second tooth portions of said pawl assembly from engagement with said gear.

* * * * *